United States Patent [19]

König et al.

[11] 4,223,519

[45] Sep. 23, 1980

[54] FALSE TWISTING-STRETCHING/TEXTURIZING MACHINE

[75] Inventors: Günter König, Uhingen-Baiereck; Günter Mütschler, Aichelberg; Erich Scheutle, Weissenstein; Erich Bucher, Göppingen, all of Fed. Rep. of Germany

[73] Assignee: Firma Zinser Textilmaschinen GmbH, Ebersbach, Fed. Rep. of Germany

[21] Appl. No.: 963,238

[22] Filed: Nov. 24, 1978

[30] Foreign Application Priority Data

Nov. 23, 1977 [DE] Fed. Rep. of Germany ..... 2752232

[51] Int. Cl.[3] ..... D01H 7/92; D01H 13/26; D01H 13/28

[52] U.S. Cl. ..... 57/291; 57/287; 57/288

[58] Field of Search ..... 57/284, 129, 287, 288, 57/290, 291; 242/18 R, 18 DD

[56] References Cited

U.S. PATENT DOCUMENTS

| | | | |
|---|---|---|---|
| 3,367,096 | 2/1968 | Comer et al. | 57/291 |
| 3,626,558 | 12/1971 | Parker | 57/291 X |
| 3,791,121 | 2/1974 | Ernst | 57/291 X |
| 3,971,517 | 7/1976 | Mataura | 242/18 R |
| 3,973,739 | 8/1976 | Nilgens et al. | 242/18 DD X |
| 4,051,650 | 10/1977 | Gleyze et al. | 57/291 |
| 4,058,961 | 11/1977 | Kubler | 57/291 |
| 4,106,274 | 8/1978 | Eaves | 57/291 |

*Primary Examiner*—Donald Watkins
*Attorney, Agent, or Firm*—Edwin E. Greigg

[57] ABSTRACT

A false twisting machine which includes a frame having racks of thread supply spools on opposite sides with centrally disposed bobbin supporting take-up mechanisms therebetween defining corridors on opposite sides thereof with thread heaters and false twisting members disposed horizontally across the top of the machine, together with thread transport mechanisms for stretching the threads and for advancing the threads vertically upward from the thread supply spools on opposite sides of the machine across the top of the machine in a horizontal path with virtually no deviation therefrom through the heaters and false twisters and then downwardly onto the take-up bobbins for ultimate removal of the wound thread packages from the machine thereby providing a machine of greatly reduced height and capable of easy maintenance.

15 Claims, 3 Drawing Figures

FALSE TWISTING-STRETCHING/TEXTURIZING MACHINE

BACKGROUND OF THE INVENTION

The invention relates to a false twisting-stretching-/texturizing machine.

Numerous machines of this type are known. However, they all have one of two disadvantages, one of these being that the threads (sometimes called multifilament yarns) are caused to suffer sharp changes in direction with a very small radius of curvature in the false twisting regions (texturizing zones) located between the false twisting members and the heaters. The other disadvantage is the fact that these machines cannot be operated and/or serviced from the floor of the building or from a low pedestal or platform.

OBJECTS AND SUMMARY OF THE INVENTION

It is thus an object of the invention to provide a machine of the above-described type which is capable of particularly low construction. Furthermore, the machine should be capable of a construction such that all of the filaments of the endless threads are displaced by the false twisting within the thread from the inside to the outside and thereafter back from the outside to the inside, and so forth.

According to the present invention, there is provided a false twisting-stretching/texturizing machine having a construction which results in numerous advantages. A low and compact machine can be produced relatively inexpensively, with relatively low height due to the fact that the threads travel from the supply spools located at one side of the service corridor, and move initially upwardly and thereafter substantially horizontally above the service corridor from which they travel downwardly to the wind-up mechanisms. For example, in an experimental machine, the overall height was only 2.2 meters and may, in many cases, be substantially less.

Furthermore, the machine may be so constructed that it may not only be operated from the service corridor but that maintenance service may also be performed from the service corridor including all of the operations connected with spool changes and on all elements including the highest lying elements and that this maintenance may be performed directly from the floor of the building or possibly from a stationary single-step platform. In many cases, such service platforms are not required.

By extending the heaters and the false twisting elements in an approximately horizontal direction and by causing the threads to travel from the heater to the false twisting elements without any or at most with very shallow change of direction, the false twist imparted to the yarn by the false twisting element travels intensively along the thread in the direction opposite to the thread propagation even beyond the heater, so that all of the filaments of the thread are continuously displaced by the false twisting operation from the inside to the outside and thereafter from the outside back to the inside, and so forth, so that each filament comes to lie at the outside in some places and, in intermediate regions, lies within the thread, which lends particularly favorable properties to the thread. In some difficult cases, especially in threads having seven filaments, it may be necessary to take additional steps to achieve this filament displacement. Such steps may be taken in the machine according to the invention without any difficulties and this would normally be done by using a further particularly simple and easy-to-perform method of the invention. If, in some cases, the application of this method of the invention would make the width of the service corridor undesirably large, then the width of the machine corridor and hence of the machine itself may be reduced by taking still further steps according to the invention. These steps may also be applied without difficulty even in connection with the first method of the invention if each of the false twisting members is provided with a separate first and second yarn supply mechanism in which the rotational axes of the rollers are disposed horizontally and perpendicularly with respect to the direction of the thread passing between them, which is itself oblique with respect to the longitudinal axis of the machine.

If it is desired to use one particularly advantageous method of the invention, this generally requires that the thread arrives at the second thread supply mechanism perpendicularly to the long extent of the machine and, for this purpose, it is desirable to dispose a thread reversal member, for example, a thread reversal roller or pin between the false twisting element and the second thread supply mechanism.

One method according to the invention is especially advantageous because it results in a minimum height of construction of the machine.

It is an advantageous arrangement of the invention to dispose the heating surface facing downwardly, thereby causing an optimum accumulation of heat because the warm air has the tendency to migrate upwardly and this tendency is counteracted by a downwardly facing heating surface. This disposition also saves heating energy and the thread is heated particularly well. However, in some cases, the heating surface may also face in another direction.

In general, one method according to the invention is suitable for obtaining short paths for the thread between the heater and the false twisting member. The presence of the rail also prevents the generation of a thread balloon between the heater and the false twisting member. The rail may be a solid rail which is cooled only by the surrounding air. By disposing the rail according to the invention, the thread is better able to cool off because the air which is heated by the hot threads upon its arrival at the rail can flow upwardly from the cooling rail in conjunction with a downwardly directed heating surface provides a particularly reliable manner of preventing the generation of thread balloons between the heater and the false twisting member.

A machine constructed according to the invention results in short constructional lengths which produces several advantages. It is especially suitable to construct the machine so as to be substantially symmetric with respect to a central longitudinal plane.

A particularly advantageous construction of a machine according to the invention is obtained because it is possible thereby to achieve substantial savings of at least some drive elements. Furthermore, a substantial reduction in width of the machine is obtained in comparison with two adjacent machines each having a separate service corridor.

The construction of the machine in which the thread wind-up mechanisms are constructed according to German Offenlegungsschrift No. 2,651,816 results in a machine which has many advantages, among which are the following. The cost of construction for each false twisting station is substantially reduced when compared with known machines having commonly used thread take-up devices in which the threads are wound up as cross-wound spools by thread-winding elements having a horizontal axis of rotation. Furthermore, it is possible to achieve extremely high thread speeds. In experiments, thread speeds of up to 1200 meters per minute were reached. By comparison with a thread take-up mechanism using a ring and traveler, one sees the advantage that the wind-up spools can be exchanged for empty take-up spools at any time. Furthermore, the machine generates substantially less noise compared with known machines.

However, it is also possible to construct the machine according to the invention with thread take-up mechanisms and, even in that configuration, it presents advantages with respect to construction, technology and cost.

In many cases, it is sufficient to provide only a single stretching field for the thread and this field may be identical to the false twisting field. However, it is also possible to install a separate stretching field ahead of the false twisting field.

In a known manner, it is generally suitable to provide a combination of the various methods of the invention, which brings about the further advantage that the vertical distance of the apparatus for applying the spool oil from the thread winding location located below it can be made rather large so that the spool oil is distributed particularly uniformly on the thread prior to take-up. When threads have previously been wound up on cross-wound spools having horizontal axes, it had been a serious disadvantage that there was a danger of spool oil being thrown from the thread, which would lead to soiling. This possibility is prevented when the wind-up mechanisms are constructed according to the invention because the direction of the thread is traversed by an eccentrically and rotatably mounted thread guide roller and the spool and the thread guide roller does not strip the oil from the thread.

The invention will be better understood as well as further objects and advantages thereof become more apparent from the ensuing detailed description of two exemplary embodiments taken in conjunction with the drawings.

DESCRIPTION OF THE PREFERRED EMBODIMENTS

Figure 1:
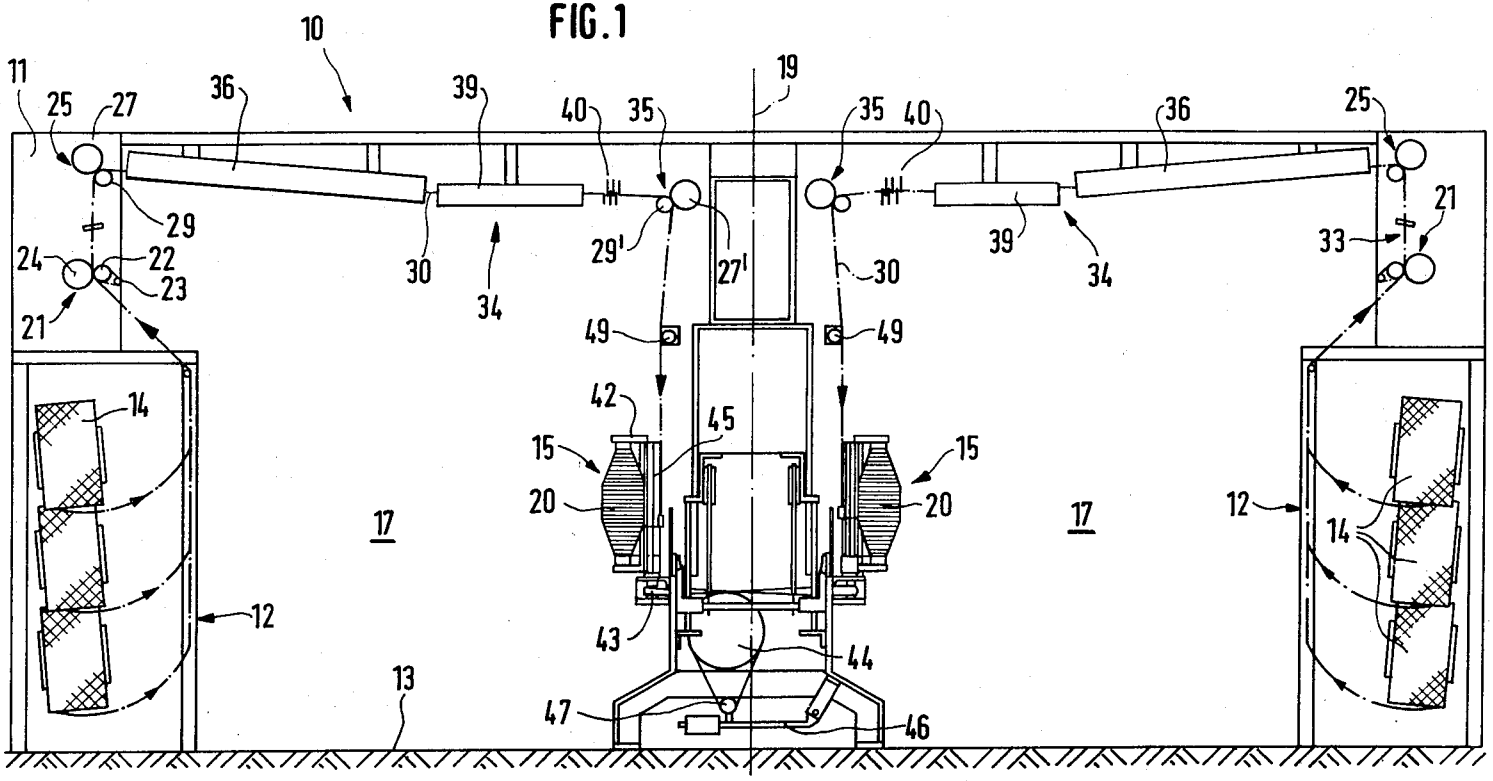
FIG. 1 is an end view of a false twisting machine according to a first exemplary embodiment of the invention.

The machine 10 illustrated in FIG. 1 includes a stationary frame 11 fastened to the floor and provided with a spool rack 12 on each of its two long outer sides. Along the central longitudinal extent of the machine, there are arranged two rows of take-up mechanisms 15 of which only the front two are shown. Located between each row of take-up mechanisms 15 and its associated spool rack 12 is a service corridor thereby creating two mutually parallel service corridors 17 extending in the longitudinal direction of the machine, i.e., perpendicular to the plane of FIG. 1. Each of the two spool racks 12 has holders, not shown, for three rows of supply spools 14. Only the forward one of each of the spools 14 in the row of supply spools can be seen in FIG. 1 and the untwisted endless thread is pulled off over the end of the spool.

Except for a few drive members for powering the take-up spools 20, the machine 10 is constructed in symmetry with respect to a longitudinal central plane 19 which is vertical to the plane of FIG. 1. The machine has a plurality of thread paths arranged in two rows, and of these only the front two thread paths can be seen because the others are hidden thereby. Each of the endless threads 30 traverses a path which leads from a supply spool 14 to a take-up spool 20.

At a relatively small distance above each of the spool racks 12 is located a row of input thread supply mechanisms 21 which pull the thread 30 from the supply spools 14 and lead them into a stretching region 33 where they are stretched. Each of the mechanisms 21 consists of a single roller 22 with a displacement roller 23 and a friction drive roller 24 for driving the roller 22. The friction drive roller 24 is a part of a string of rollers which constitutes all of the friction rollers on a particular row of input supply mechanisms 21.

Vertically above each of the input supply mechanisms 21 is located a first thread supply system 25 which is located just below the top of the frame 11 of the machine 10 and thus in the vicinity of the highest location in the machine. This thread supply system 25 transports the threads 30 at a higher velocity than the supply mechanisms 21 so that they are stretched in the stretching regions 33.

The first thread supply mechanism 25 consists of a pair of rollers 27, 29. One roller 27 of this pair of rollers is formed by a section of a driven roller string which is associated with all of the first supply mechanisms 25 arranged in a row. Pressing against the rollers 27 are single pressure rollers 29 having elastic coverings for pinching the threads 30. These first thread supply mechanisms 25 guide the threads without slippage into false twisting fields 34 from which they are pulled without slippage by second thread supply mechanisms 35.

The supply mechanisms 25, 35 limit the extent of the false twisting fields 34 and the thread transport speeds provided by the second supply mechanisms 35 can be, as required, smaller, equal to or larger than the speeds of the first supply mechanisms 25. If stretch fields 33 are omitted or are not adjusted to maximum stretching of the threads, the stretching can take place in the false twisting fields 34 or may be completed there.

Located at a short distance behind each first thread supply mechanism 25 in the direction of thread travel is an elongated heater 36 which serves to heat a particular thermoplastic thread 30. This heater 36 is formed by a heating plate having a slightly concave bottom groove extending in the longitudinal direction with whose base the thread 30 makes contact. Following the heater 36 at a short horizontal distance is a cooling rail 39 which is supported by a carrier of the frame 11 as is the heater 36. The cooling rail 39 has a slightly concave groove at its top surface extending in the longitudinal direction with whose base the thread makes contact for the purpose of being cooled.

Disposed behind the cooling rail 39 in the direction of thread travel and in the path of the particular thread is a false twisting member 40. Each of the known false twisting members 40, which are disposed in two rows, has in this illustrated embodiment three axially parallel driven shafts on which are mounted friction discs which force the thread between them to traverse a zig-zag path and which thus rotate the thread at high speed and impart to it the false twist which is then thermally fixed. Disposed behind the associated false twisting member 40 in the direction of the thread travel is the second thread supply mechanism 35 which has a driven roller 27' which is also a portion of a driven roller string that constitutes all of the rollers 27' of that particular row of supply mechanisms. The pressure rollers 29', which together with the driven rollers 27' pinch the thread, are individual rollers.

The first and second supply mechanisms 25, 35 deviate the threads by approximately 90° in each case. Between the two supply mechanisms 25, 35, each of the threads travels practically in a straight line and approximately horizontally except for the very slight deviations imparted to the thread by the heater 36 and by the cooling rail 39 and except for the zig-zag path of the thread through the false twisting member 40. From the second supply mechanism 35, the thread 30 travels vertically downwardly past a device 49 which applies spool oil to the thread and then continues its downward vertical travel to a thread take-up location 15.

In the illustrated embodiment of FIG. 1, each thread take-up location 15 is a so-called "sidewinder" according to the description in the German Offenlegungsschrift No. 2,651,816 assigned to DuPont of Canada. This sidewinder includes a pivotably mounted spool holder 42 with a vertical axis of rotation for supporting the take-up spool 20. The spool holder 42 is spring-loaded so that it presses the take-up spool 20 with the thread package being wound thereon against a cylindrical friction roller 45 which is driven by a small belt 43 by a central drive drum 44, the circumferential speed of the friction roller 45 corresponding to the take-up speed of the particular thread. This take-up speed could be as high as 1200 meters per minute in experiments.

The thread arriving vertically from above arrives at the take-up location 15 and first meets an eccentrically mounted thread deviating roller driven by the thread itself which deviates the thread from its vertical direction into a horizontal direction and guides it into the pinch line between the friction roller 45 and the thread winding package on the spool 20. The eccentrically mounted thread deviating roller causes a rapid to-and-fro motion (traversing motion) so that the thread is wound up on the spool with criss-cross windings meeting at substantial angles. The traverse movement of the thread deviating roller causes the thread to be wound up on the thread package in such a way as to create two slopes. This construction of the thread take-up locations 15 has a number of advantages which have already been pointed out above.

As may be seen from FIG. 1, the longitudinally extending heating plates 36 are not located in an exact horizontal position but are slightly inclined with respect to the horizontal plane. This is necessary if the heating plates are to operate on the condensation principle. In all other cases, they may be disposed exactly horizontally. As shown in FIG. 1, the path of the thread 30 from the first supply mechanism 25 to the second supply mechanism 35 is as straight as possible without any thread deviating points and extends approximately horizontally. This fact insures the optimum degree of false twisting for the thread so that, even in the most difficult cases, especially when threads having up to seven filaments are used, each of the filaments is alternately moved from the interior of the thread to the outside and then back again from the outside to the inside and this process is continuously repeated. As a result, there is produced a thread of uniform twist which has very favorable advantages regarding its properties and its further processing.

Furthermore, in the illustrated embodiment, the path of the thread between the first and second supply or transport mechanisms 25, 35 is perpendicular to the longitudinal extent of the machine. However, in accordance with the invention FIG. 3 shows that the threads travel from the first to the second supply mechanism at equal angles of approximately 10°–35° with respect to the longitudinal extent of the machine, from the outside of the machine toward the interior, and in an approximately horizontal direction.

Figure 3:
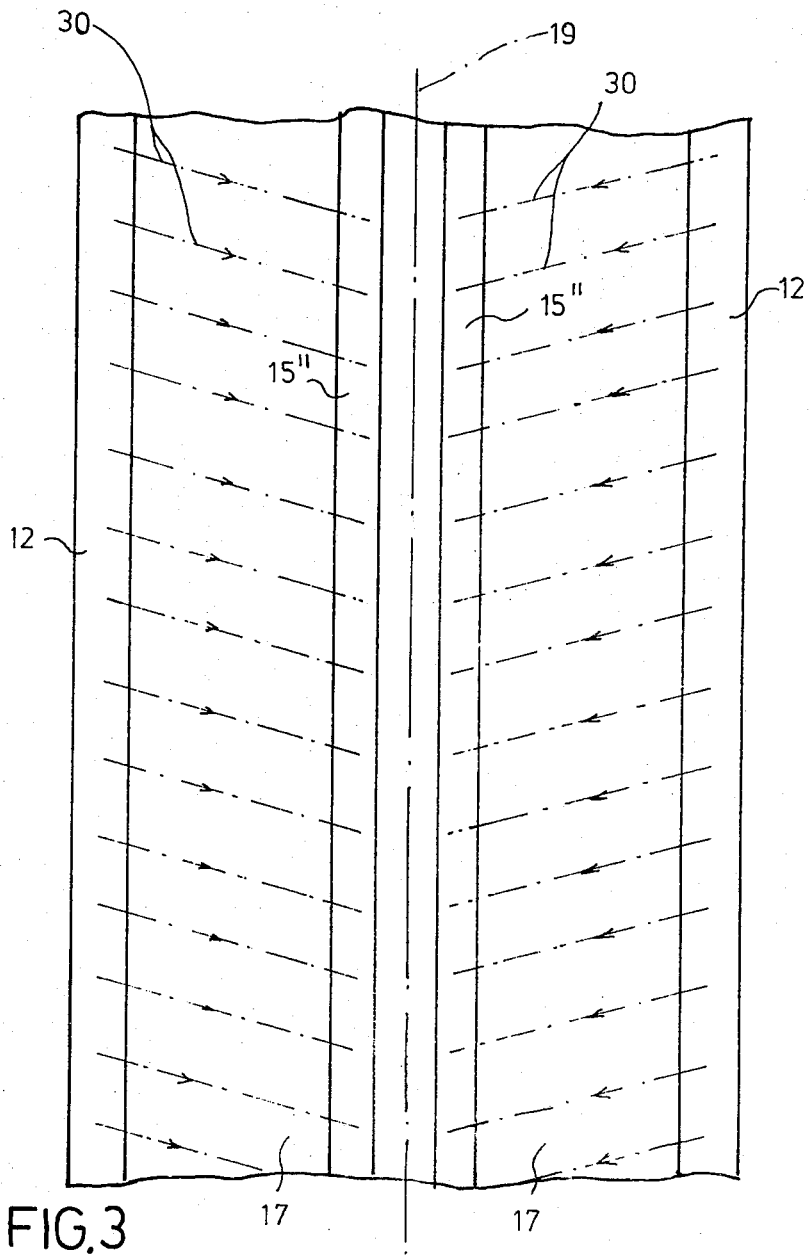
FIG. 3 is a schematic plan view of the false twisting machine of the invention.

In FIG. 3, there is shown schematically a plan view of the machine of FIG. 1 having two service corridors 17 with the thread travel paths 30 leading approximately horizontally across the service corridors 17 indicated in "—" lines. In FIG. 3, the thread guide devices and thread handling devices are not shown and, as shown in FIG. 3, the approximately horizontal travel paths 30 of the threads extend obliquely towards the vertical longitudinal central plane 19 of the machine. The spool racks 12 and the take-up mechanisms 15'' are shown only schematically.

The small belts 43 which serve to drive the friction rollers 45 are tensioned by tension rollers 47 which are loaded by weighted levers 46.

The manner of operation of this machine is as follows:

The first or input transport mechanism 25 pulls off a thread 30 to be false twisted from its associated supply spool 14 and guides it without slippage into the stretching field 33 in which it is stretched only and not yet false twisted. From the vertically extending stretching field 33, the thread 30 travels without slippage into the approximately horizontally extending false twisting field 34 in which it is further stretched and also heated by the heaters 36, whereafter it is cooled off by the cooling rail 39 and is false twisted by the false twisting member 40. The false twist applied to the thread is then thermally fixed in this field 34.

The thread 30 leaves the false twisting field 34 without slippage due to the operation of the second supply mechanism 35 and then travels downwardly past the spool oil applicator 49 to the take-up location 15 where it is wound up on a spool 20. When the spools 20 are filled up, they are exchanged for new spools. The exchange may be performed manually or by automatic spool changers, not shown. Without affecting the take-up process at any other spool, each of the spools 20 may be exchanged for a new spool, whereafter the take-up process at that particular location may be started anew.

The illustrated machine also has the advantage that all maintenance operations may be performed from the service corridors 17 requiring at most the presence of low stationary platform boards for the operator to stand on when the components 25, 36, 39, 40, 35 are serviced. The machine 10 may also be constructed in different lengths on the basis of modular construction. The overall servicing of the machine during operation also takes place from the service corridors 17.

Figure 2:
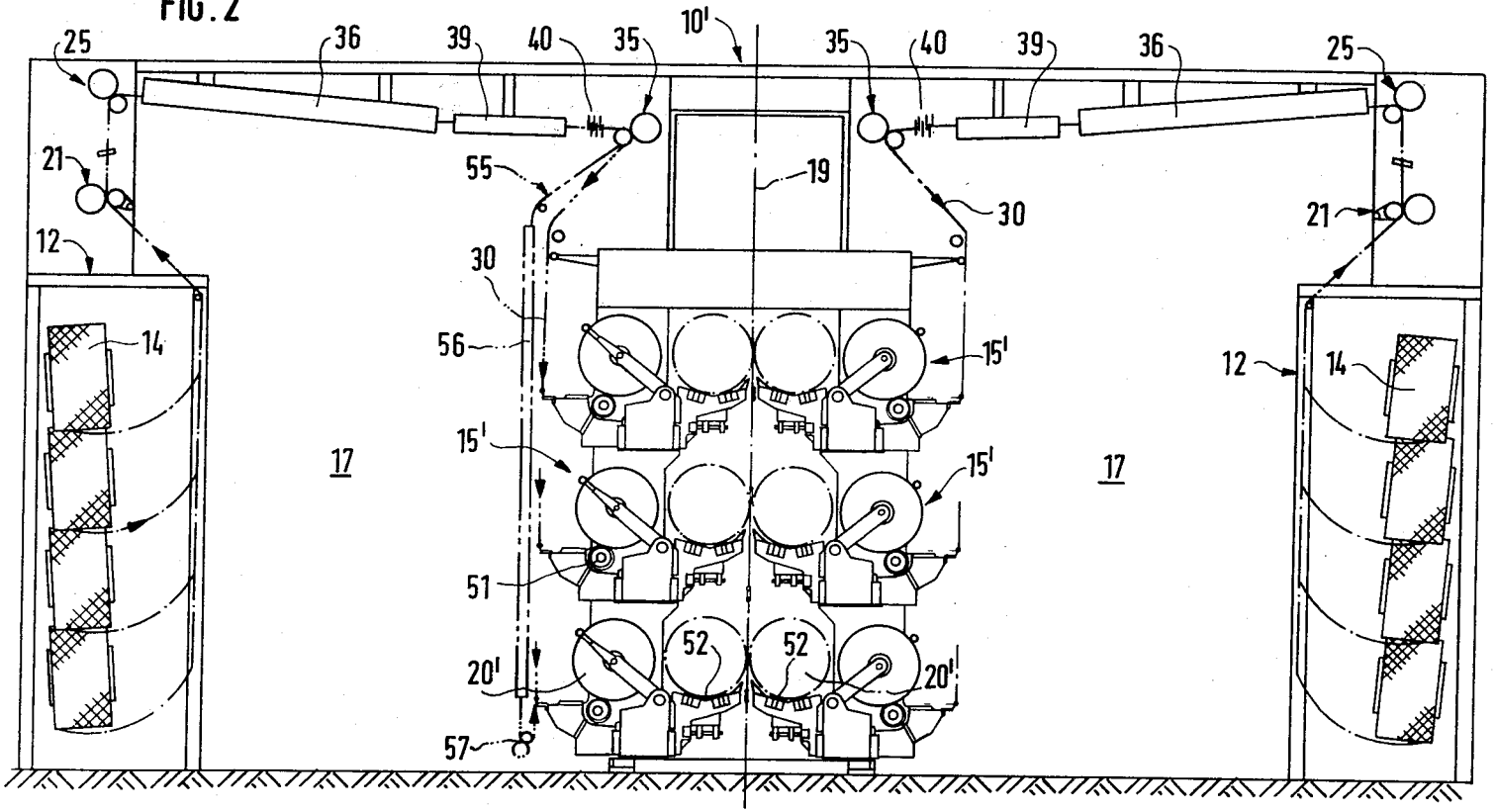
FIG. 2 is an end view of a false twisting machine according to a second exemplary embodiment of the invention identical to that of FIG. 1 except for the differently constructed wind-up mechanisms and the presence of a larger spool cage.

FIG. 2 is an illustration of the second embodiment of the invention in which those parts which are identical to the machine 10 of FIG. 1 carry the same reference numerals.

The machine 10' of FIG. 2 differs from that illustrated in FIG. 1 only by the different construction of the thread take-up locations 15 and by the presence of a larger spool rack 12. In the machine according to FIG. 2, the take-up locations 15' are commonly used cross-spool take-up mechanisms in which the cross-spools 20' have horizontal axes of rotation. This kind of construction permits winding up larger and heavier thread packages than is possible with the spools as arranged in the embodiment of FIG. 1, but requires a greater construction effort and higher costs for each of the take-up locations 15'. Furthermore, the machine according to FIG. 2 makes substantially more noise than that of FIG. 1 because the take-up mechanisms 15' themselves generate much more noise than those illustrated in FIG. 1.

The machine 10' according to FIG. 2 is substantially symmetrical with respect to its longitudinal central plane 19 and, as was the case for the machine of FIG. 1, has two mutually parallel service corridors 17 from which the service and maintenance of all parts of the machine may take place as in the embodiment of FIG. 1.

Adjacent to each of the service corridors 17, in the vicinity of the middle of the machine, three rows of thread take-up locations 15' are stacked vertically. Each of the take-up locations 15' includes a drive roller 51 having a horizontal axis of rotation against which the cross-spool 20' to be wound is disposed for rotation. The thread 30 is guided to the cross-spool 20' by a traversing thread guide. Take-up mechanisms of this type are well known and do not require further explanation.

Disposed between each two rows of take-up mechanisms 15' located at the same height are two endless driven transport belts 52 extending in the longitudinal direction of the machine and serving for holding and transporting the filled-up cross-spools 20'. When a spool change takes place, the operator rolls the filled-up cross-spool 20' from the take-up location 15' onto the slightly concave transport belt 52 located just behind it and mounts a new empty spool in its place. When the spool exchange is terminated, the conveyor belts 52 are set into motion and transport the full spools 20', shown in broken lines, beyond the end face of the machine to a discharge station where they may be moved to a second conveyor belt, a carriage, or the like, for the purpose of further transport.

The machines 10 and 10' also have the advantage of requiring only a very few thread deviating locations for each thread path and those thread deviations that do take place do not exceed approximately 90°. Furthermore, the machine includes no thread paths which do not perform a processing function so that the thread paths have practically the minimum possible length.

If it is desired to "set" the false twisted threads on the false twisting-stretching/texturizing machine, i.e., to produce set yarns, this may be done advantageously by guiding the threads from the second supply mechanism 35 into setting fields 55 as is shown in broken lines in the left half of the embodiment of FIG. 2, and these setting fields 55 are provided with longitudinally extending vertical heaters 56 located just ahead of the take-up locations 15'. Disposed below the heaters 56 are third transport mechanisms 57 which guide the threads upwardly to the take-up locations 15'. The setting of threads is known to the person skilled in the art and serves to reduce the elasticity of the threads. It should be understood that such setting fields could also be provided for the right half of the machine 10' as well as for the machine 10 of FIG. 1 or for any other machine constructed according to the invention. The presence of the heaters 56 does not impede the servicing of the take-up locations 15' because they are narrow and are disposed opposite the space which exists between adjacent wind-up locations.

The foregoing relates to two preferred embodiments of the invention, it being understood that other embodiments and variants thereof are possible within the spirit and scope of the invention, the latter being defined by the appended claims.

What is claimed and desired to be secured by Letters Patent of the United States is:

1. A false twisting-stretching/texturizing machine for endless threads, especially in the titer region dtex 17-220, each thread comprising about 3–48 filaments, and including a plurality of false twisting members each arranged to false twist one of the threads, a service corridor extending in the longitudinal direction of the machine, a spool rack for holding supply spools and a thread take-up location having a movable take-up spool adjacent the service corridor associated with each of said false twisting members, a first thread supply mechanism associated with each false twisting member which supplies threads thereto, a second thread supply mechanism further associated with each false twisting member which transports the threads coming from the false twisting members and heaters disposed between the first thread supply mechanisms and the false twisting members, heating the threads, characterized in that;

said supply spool rack is located on one side of the service corridor and said thread take-up mechanisms are located on the other side of said service corridor, said first thread supply mechanisms are located above said supply spool rack and said second thread supply mechanisms are located above said thread take-up locations, and said heaters and said false twisting members are disposed approximately horizontally whereby each of said threads travels from its associated heater to the associated false twisting member in an approximately straight line and approximately horizontally and wherein said heater includes a longitudinal, downwardly directed heating surface, said heating surface being provided with a concave groove having a base extending in the direction of travel of said thread, the base of said groove making contact with the advancing thread for the purpose of heating.

2. A machine according to claim 1 wherein said second thread supply mechanisms are disposed at approximately the same height as said first thread supply mechanisms.

3. A machine according to claim 1 wherein said thread travels from said first thread supply mechanism to the associated heater without deviation and experiences substantially no change of direction due to the heater.

4. A machine according to claim 1 wherein said thread travels from said false twisting member approximately in the same direction in which it arrived and continues to travel from said false twisting member to said second thread supply mechanism without deviation.

5. A machine according to claim 1 including a metallic rail disposed between said heater and said false twisting member for cooling and quieting the motions of said thread.

6. A machine according to claim 5, wherein said rail is provided with an upwardly open longitudinal groove for receiving the thread.

7. A machine according to claim 1 wherein the path of the thread from said first thread supply mechanism to said second thread supply mechanism is perpendicular to the longitudinal extent of the machine.

8. A machine according to claim 1 wherein the direction of thread advance from said first thread supply mechanism to said second thread supply mechanism is oblique with respect to the longitudinal extent of the machine.

9. A machine according to claim 1 including two of said service corridors arranged in parallel relationship and a plurality of false twisting fields disposed above each service corridor.

10. A machine according to claim 9 including said thread take-up locations and disposed adjacent to the neighboring sides of said two service corridors.

11. A machine according to claim 1 wherein said thread take-up locations are of the sidewinder type and are disposed adjacent to said service corridor, said take-up spools having vertical axes of rotation, and a plurality of vertical friction rollers disposed in contact with the thread packages for driving said take-up spools at substantial cross-winding angles.

12. A machine according to claim 1 including a plurality of rows of said thread take-up locations disposed atop one another adjacent to each said service corridor and said take-up spools having horizontal axes of rotation.

13. A machine according to claim 1 including a stretching field disposed ahead of the field of said false twisting member, said stretching field including an inlet thread supply mechanism located beneath said first thread supply mechanism.

14. A machine according to claim 1 including a spool oil applicator device located approximately vertically below said second thread supply mechanism for applying spool oil to the downwardly traveling thread.

15. A machine according to claim 12 including a plurality of rows of said thread supply mechanisms and a plurality of driven rollers associated with at least said first and second thread supply mechanisms of each said row of thread supply mechanisms, said plurality of driven rollers being formed by portions of a single straight roller string.

* * * * *